US008708762B2

(12) United States Patent
Samelian

(10) Patent No.: US 8,708,762 B2
(45) Date of Patent: Apr. 29, 2014

(54) RESCUE DEVICE

(76) Inventor: John K. Samelian, Mendota Heights, MN (US)

( * ) Notice: Subject to any disclaimer, the term of this patent is extended or adjusted under 35 U.S.C. 154(b) by 0 days.

(21) Appl. No.: 13/573,177

(22) Filed: Aug. 28, 2012

(65) Prior Publication Data

US 2013/0237108 A1 Sep. 12, 2013

Related U.S. Application Data

(60) Provisional application No. 61/634,729, filed on Mar. 6, 2012, provisional application No. 61/634,732, filed on Mar. 6, 2012.

(51) Int. Cl.
*B63C 9/08* (2006.01)

(52) U.S. Cl.
USPC ..... 441/81

(58) Field of Classification Search
USPC ..... 441/81, 84, 80
See application file for complete search history.

(56) References Cited

U.S. PATENT DOCUMENTS

| | | | | |
|---|---|---|---|---|
| 2,342,868 | A * | 2/1944 | King | 441/81 |
| 4,416,640 | A * | 11/1983 | Eickenhorst | 441/81 |
| 5,562,512 | A * | 10/1996 | Samelian | 441/81 |
| 6,413,134 | B1 * | 7/2002 | Wahl et al. | 441/84 |
| 6,629,867 | B1 * | 10/2003 | Smith | 441/81 |
| 6,659,823 | B1 * | 12/2003 | Mosna et al. | 441/84 |
| D493,922 | S * | 8/2004 | Klotz | D29/124 |
| 7,189,129 | B2 * | 3/2007 | DeMange | 441/81 |
| 7,285,032 | B2 * | 10/2007 | Cha | 441/81 |
| 8,216,014 | B2 * | 7/2012 | Samelian | 441/81 |
| 2002/0072286 | A1 * | 6/2002 | Smith | 441/80 |

* cited by examiner

*Primary Examiner* — Lars A Olson
*Assistant Examiner* — Jovon Hayes

(57) ABSTRACT

A throwable rotatable rescue device having a cord wound therein including a cord reel for storing and unwinding the cord therefrom as the rescue device is thrown. One end of the cord is detachably mounted to the rescue device to enable a person receiving a thrown rescue device to reach into an interior region of the rescue device and detach the cord from the rescue device. Thereafter one can attach the cord to an object that can be retrieved by pulling on the cord.

17 Claims, 10 Drawing Sheets

RESCUE DEVICE

CROSS REFERENCE TO RELATED APPLICATIONS

This application claims priority of provisional application Ser. No. 61/634,729 filed Mar. 6, 2012; provisional application; Ser. No. 61/634,732 filed Mar. 6, 2012.

STATEMENT REGARDING FEDERALLY SPONSORED RESEARCH OR DEVELOPMENT

None

REFERENCE TO A MICROFICHE APPENDIX

None

BACKGROUND OF THE INVENTION

This invention relates generally to rescue devices and, more specifically, to improvements to rescue rings that increase the versatility and the range of a rescue ring. Examples of lightweight rescue rings, which have an aerodynamic shape, can be found in my U.S. Pat. Nos. 5,562,512 and 8,216,014. My aerodynamic rescue rings have an excellent throwing range and are ideally suited for water rescue since the rescue rings are buoyant and can be hand thrown by an inexperienced person. Typically, a cord, which is secured to the rescue ring, unwinds from a cord reel located in the rescue ring as the rescue ring is thrown to a person in distress. The other end of the cord, which is retained by the thrower or is affixed to structure, allows the thrower to retrieve the rescue ring by pulling on the cord. Consequently, when the rescue ring reaches its destination a person in distress can grasp the rescue ring and be pulled to safety by the cord, which is attached to the rescue ring. On some occasions one may want to retrieve objects other than a person, for example, one may want to bring a boat into dock or to rescue a boat in distress. To pull larger or various types of loads the rescue ring may not have sufficient structural and tensional integrity since the rescue rings are generally made of lightweight materials so that they can be thrown long distances. In other cases it simply may be inconvenient to attach the rescue ring to an object.

SUMMARY OF THE INVENTION

A throwable rotatable rescue device having a cord wound therein with the rescue device comprising an annular member having an upper outer peripheral surface having an airfoil shape and an inner upper peripheral surface having an airfoil shape, with the upper outer peripheral surface forming a leading edge of the annular member and the inner upper peripheral surface forming a trailing edge of the annular member. The rescue ring includes various features to enhance the grasping and throwing of the rescue ring as well as the versatility of the rescue ring through use of a detachable cord that is wound on a cord reel that stores and unwinds the cord therefrom as the rescue device is thrown. One end of the cord, which includes an attachment member that is detachably mounted in a pocket in the rescue ring so as not to interfere with the winding or unwinding of the cord as well as the aerodynamics of the ring during flight but is readily accessible to a person receiving the ring to enable the person to quickly detach the cord and the attachment member from the rescue device. Thereafter the person can attach the attachment member to an object that can be retrieved by pulling on the cord.

DESCRIPTION OF THE PREFERRED EMBODIMENT

Figure 1:
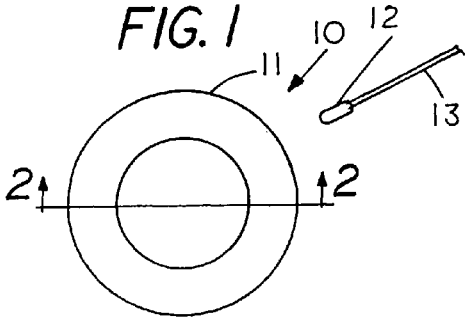
FIG. 1 is a top view of a rescue ring with a detachable hook.

FIG. 1 is a top view of a multi use rescue device or rescue system 10 comprising a rescue ring 11 with an attachment member comprising a detachable hook 12 which is connected to one end of a cord 13 that is windable about a cord reel 13*a* in the rescue ring 11. To use rescue ring 11 a person grasps and throws the ring 11 while imparting a rotational motion to the ring 11 which causes ring 11 to rotate about its rotational center that in turn causes cord 13 to unwind from the reel as the ring 11 rotationally glides through the air. Typically, rescue ring 11 is made from a lightweight material that floats if the rescue ring lands on water, however, the rescue ring requires sufficient mass so that the momentum imparted to the rescue ring can be hand thrown to its destination. The rescue ring 11 may be molded from a polymer plastic with the material having sufficient tensional strength so that when pulling on the cord, which is attached to the rescue ring, a person in peril of drowning can grasp the rescue ring and be pulled to safety by holding on to the rescue ring. Examples of rescue rings can be found in my U.S. Pat. Nos. 5,562,512 and 8,216,014 which are hereby incorporated by reference.

Figure 2:
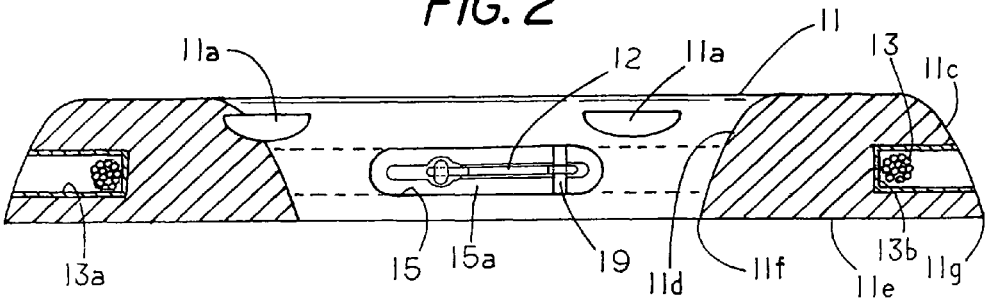
FIG. 2 is a sectional view taken along lines 2-2 of FIG. 1 showing a detachable hook located in a pocket that extends through the rescue ring.
Figure 3:
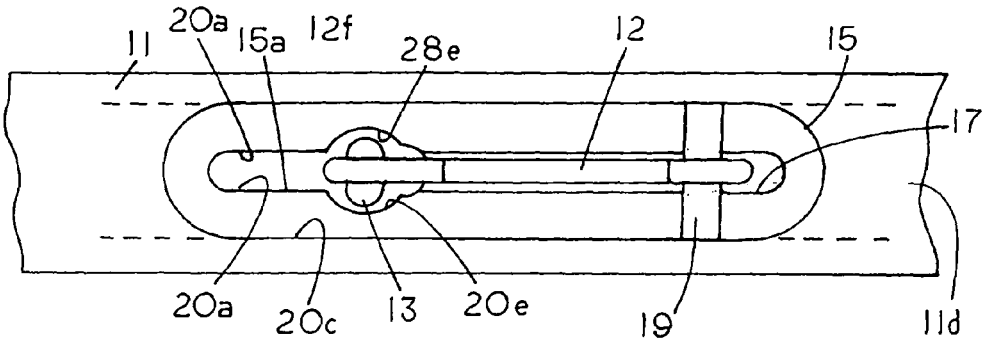
FIG. 3 is an enlarged view of the detachable hook located in a pocket in the rescue ring.

FIG. 2 is a sectional view taken along lines 2-2 of FIG. 1 revealing cord 13 wound around an annular cord reel 13*a*, which is formed by an annular internal recess in ring 11. Rescue ring 11 comprises an annular member having an upper outer peripheral surface 11*c* having an airfoil shape and an inner upper peripheral surface 11*d* having an airfoil shape, with the upper outer peripheral surface forming a leading edge of the annular member and the inner upper peripheral surface forming a trailing edge of the annular member. A lower annular surface 11*e* connects to an outer annular edge 11*g* of the upper outer peripheral surface and on the opposite side to an inner annular edge 11*f*. In this example the lower annular surface 11*e* comprises a plane surface, however, other shapes may be used as shown and described hereinafter. While Located on the inner upper peripheral surface 11*d* and extending through the annular member 11 is an open ended fastener pocket 15 having a chamber 15*a* that holds a detachable fastener 12 therein. A reference to FIG. 3 shows an enlarged front view of fastener pocket 15 revealing the detachment member, which comprises a hook 12, which typically may be a carbineer or the like that is releasably secured to a hook holder which in this example comprises cylindrical post 19 that is fixedly mounted in annular member 11. Typically, hook 12 is made of metal or the like and has sufficient structural integrity so that an object attached to the hook can be retrieved without the hook releasing. When hook 12 is snapped around post 19 the post retains the hook 12 in ring 11 thereby anchoring one end of the cord 13 to the rescue ring 11, which enables one to retrieve the rescue ring and a person in peril who grasps the rescue ring. Detachable hook 12, which is shown in side view in the rescue ring 11 in FIG. 3 and in top view in FIG. 5, provides an alternate retrieval method that increases the versatility of the rescue ring since the hook 12 can be detached from the rescue ring 11 to permit other uses of the rescue ring by attachment of the cord and the hook 12 to other objects or persons.

Figure 5:
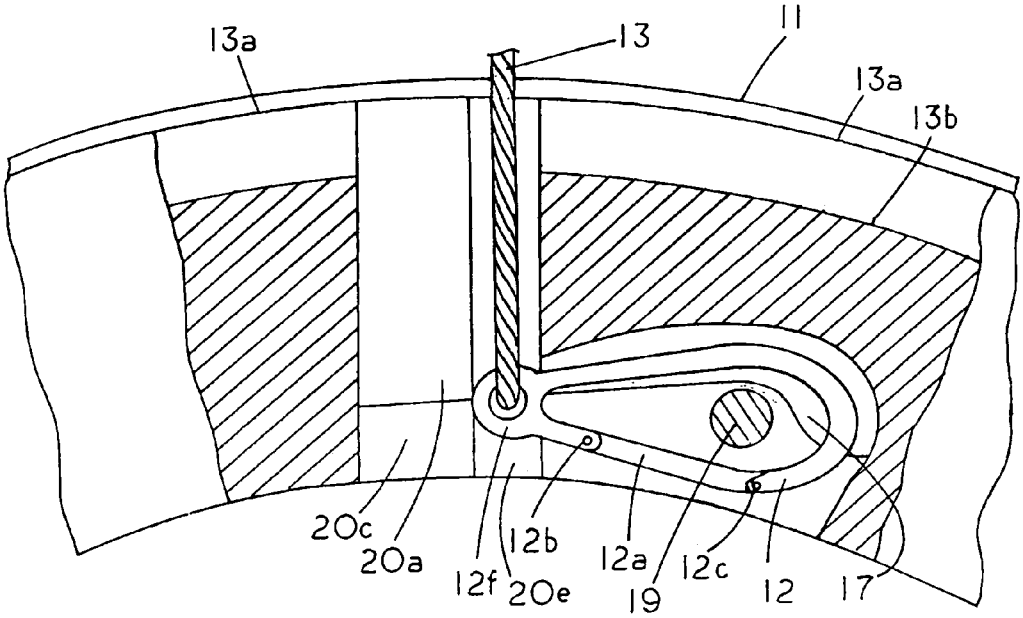
FIG. 5 is the partial sectional view of FIG. 4 showing the hook secured to the rescue ring.

FIG. 3 and FIG. 5 show that a loop 12*f* on one end of hook 12 connects to cord 13 with the remaining portion of cord 13 extending radially outward until it winds around cord reel 13*a* (FIG. 2), which is formed by an annular recess located on the outer peripheral portion of annular member 13. As the rescue ring 11 is thrown it rotates unreeling cord 13 from cord reel 13*a*. FIG. 3 shows hook 13 extends in a lengthwise or circumferential direction as it is supported within the upper and lower rescue ring sidewalls 17, 20*e* and 20*a*, which form part of an open ended fastener pocket 15. A feature of the fastener pocket 15 being open on both ends is that having pocket 15 extend through the annular member 11, including the cord reel 13*a*, allows hook 12 to be attached and detached from inside the annular ring by a person who is being rescued. Having hook 12 located radially inward from the cord reel 13*a* prevents the hook 12 from interfering with the unwinding of the cord 13 from reel 13*a* as well as the flight of the rescue ring. To detach hook 12 one reaches into the center of the rescue ring 11 and engages link lever 12*a*, which pivots about pin 12*b*, thus opening hook 12 to enable hook 12 to be detached from post 19. Freeing hook 12 from post 19 allows the hook 12 to be axially orientated in a radial direction, which allows one to pull the hook radially outward through the outer peripheral openings in open-ended fastener pocket 15. That is, pocket 15 contains a slot that is formed by upper and lower surfaces 20*a* and upper and lower surface 20*e* which are each sufficiently spaced from each other to allow the hook 12 to freely pass from the inside of ring 11 to the outside of ring 11.

In the example shown in FIG. 5 the cord reel 13*b* is a part of the rescue ring and rotates with the rescue ring. In this application the pocket 15 extends radially through the rescue ring. In the event the rescue ring includes an internal rotatable cord reel the hook 12 will rotate with the rotatable cord reel and the pocket for holding the hook will be located in the cord reel. In addition, the rescue ring will also include an open end pocket or access port where a person can align with the open pocket in the cord reel to enable a person to reach through the rescue ring and into the pocket in the cord reel to release the hook mounted in the cord reel. For convenience there may be two or more access ports in the rescue ring for quick alignment of the access port in the rescue ring with the reel pocket containing the hook.

When the hook is in the attached condition and in the circumferential position as shown in FIG. 3 and FIG. 5 the upper and lower sides 17 of pocket 15 and post 12 limit movement of the hook 12 within the pocket 15 during the rotational flight of the rescue ring. By limiting hook movement or maturing the hook 15 in fixed or a stable condition within the annular ring 11 can lessen or inhibit the effects of having an off center weight that potentially can dynamically unbalance the rescue ring during its rotational flight.

Figure 3A:
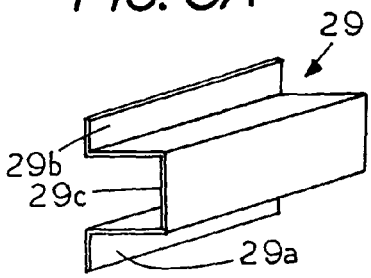
FIG. 3A is a perspective view of a slide that can be used to retain the hook in the pocket in the rescue ring.
Figure 4:
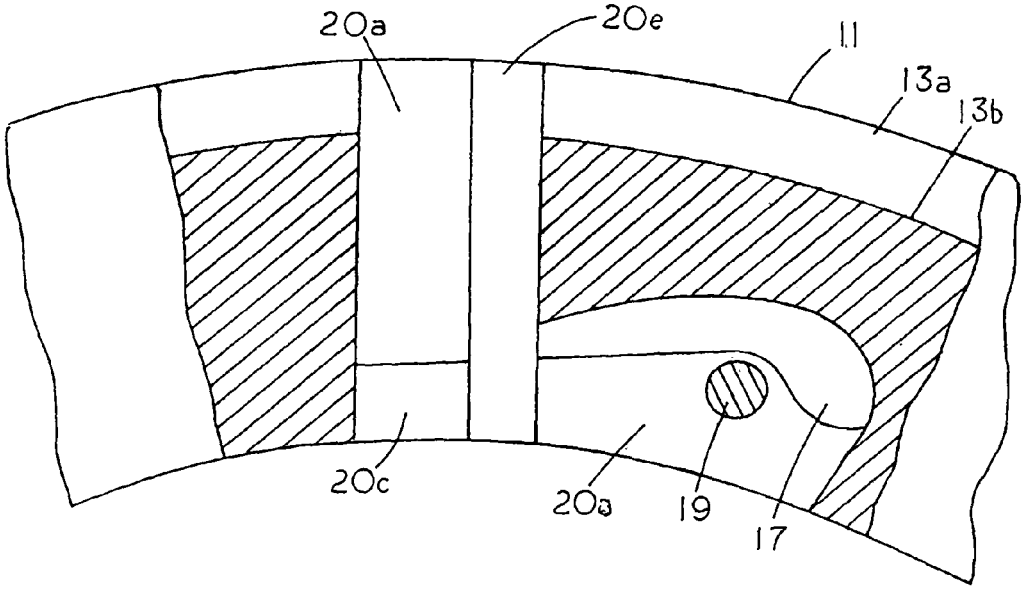
FIG. 4 is a partial sectional view showing a hook passage extending through the rescue ring.

FIG. 3A is a perspective view of a U shaped slide fastener 29 that can be used to retain the hook 12 in the pocket in the rescue ring. The slide 29 fastens into a groove or rail (not shown) in the rescue ring which allow the slide fastener to be slid over the hook 12 to retain the hook within the pocket. Slide 29 contains a first rail 29*b* and a second rail 29*a* that slide in the grooves or track of the rescue ring with the member 29*c* slideable over the hook to hold the hook in position.

The purpose of the attachment and detachment of the cord 13 from the rescue ring enhances the versatility of the rescue ring as it enables the rescue ring to be used not only under various rescue or recovery conditions but in conventional activities such as boat docking or boat rescuing. For example, if someone is in a boat or other device that needs to be pulled to safety the rescue ring 11 with the hook 12 attached thereto can be thrown to the person who upon receiving the rescue ring releases the hook 12 from the rescue ring. The hook 12 can then be attached to a boat or the like which can then be pulled to safety by the person holding the cord.

While the rescue ring 11 has its most beneficial use in water rescues the use of the releasable cord permits the rescue ring to be used in a number of different conditions where a line needs to be delivered to a person. For example, in some cases heavy dock ropes need to be delivered to an incoming boat. With the invention described herein a boat person can throw the ring 11 to a person on shore who detaches the cord and attaches the hook to a heavier docking rope, which the boat person then uses to pull the docking rope to the boat to enable the boat person to use the heavier rope for docking the boat. In other cases the person on shore could throw the rescue ring to the boat person who attaches the ring to a heavier boat docking rope, which the person on shore uses to pull the boat to shore.

Figure 2A:
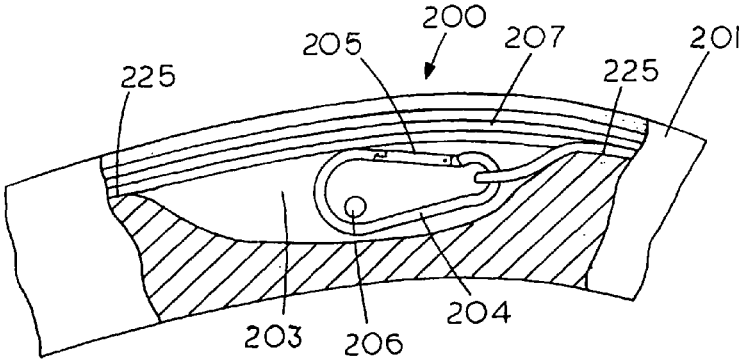
FIG. 2A is a sectional view of a detachable hook located in an external pocket located in a well in the rope reel of a rescue ring.

FIG. 2A is a partial sectional view of a second type of rescue ring 200 where a detachable hook or an attachment member 204 is located in at least partially radially inward of an annular cord reel surface 225 in a well or pocket 203 of a rescue ring 200 so as not to interfere with the winding or unwinding of cord 207 from reel surface 225. The well or pocket surface comprising an internal hollow within the rescue ring so as to minimize dynamic effects as well as winding and unwinding of cord on the reel. In this example a cord 207 is wound over the detachable hook 204, which is held in pocket 203 of ring 200 by a post 206. The pocket 203, which extends radially inward as well as circumferentially, is sufficiently large so that the hook 204 can be maintained in low profile to rope 207 that is wound around the annular cord reel surface 225 but sufficiently small so that the hook is limited in its movement as the rescue ring is thrown to a person in distress. In the example shown the shape of pocket 203 is symmetrical so that the cord can be wound from clockwise or counter clockwise, however, other non symmetrical shapes may be used without departing from the spirit and scope of the invention. As can be seen in FIG. 2A, in this embodiment the hook 204 is only accessible from a position radially outward of the reel surface 225. The winding of the cord 207 around the reel surface 225 places tension on the cord to thereby help maintain the hook 204 in a stable fixed position until the rescue ring arrives at its destination. If not all of the cord is unwound when the rescue ring arrives at its destination a person can quickly unwind the cord by pulling the cord 207 while holding the rescue ring 200. In this example a person can reach into the internal radial pocket 203 of rescue ring from outside the rescue ring to quickly release the hook 204 by pressing on latch 205 to thereby unhook hook 204 from pin 206. The person can then attach the hook to an object which is to be pulled to safety. In this example the pocket 203 is elongated so that the hook 204 can be fastened in either a clockwise direction or a counter clockwise direction so that the cord 207 can be wound in a clockwise or counter clockwise direction while maintain the hook 204 in the pocket.

Figure 2B:
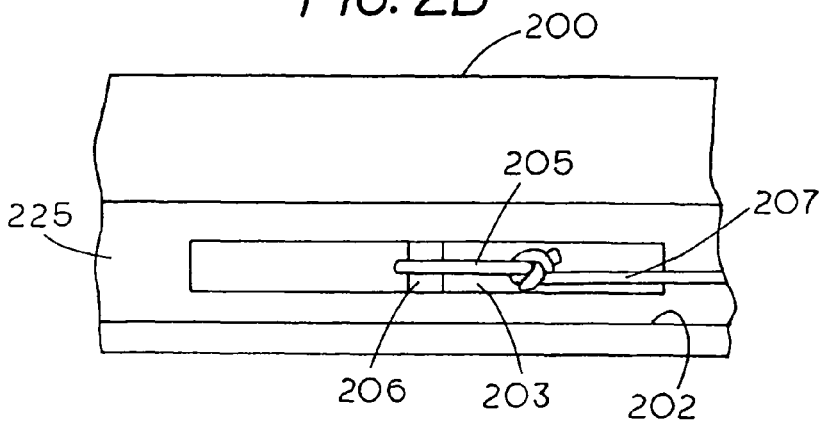
FIG. 2B shows the external circumferential detachable hook pocket.

FIG. 2B shows an outside view of the external circumferential detachable hook pocket 203 without the hook therein or the cord wound around the reel 202. The post 206 extends through the elongated pocket 203 to hold the hook 205 in position during the throwing of the rescue ring.

Figure 2C:
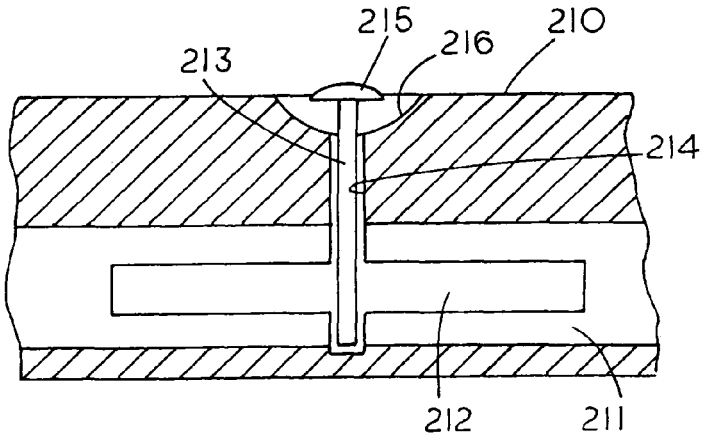
FIG. 2C shows the external circumferential detachable hook pocket with a removable pin.

FIG. 2C shows a partially sectional view of a rescue ring 210 showing external elongated circumferential detachable hook pocket 212 with a removable pin 213 having a head 215 that may be frictionally held in recess 216 so as not to protrude an interfere with the throwing of the rescue ring 210. In this example no cord is wound around the reel 211. However, if a cord and hook were attached the hook would be internal to the cord which would be wound on reel 211. In this example to release the hook from the rescue ring one pulls pin 213 axially outward from recess 214, which would allow the hook to be released without having to unsnap the hook. This type of unit is useful if the hook is replaced by an attachment member such as a ring or loop which can be used to attach to an object.

Figure 2D:
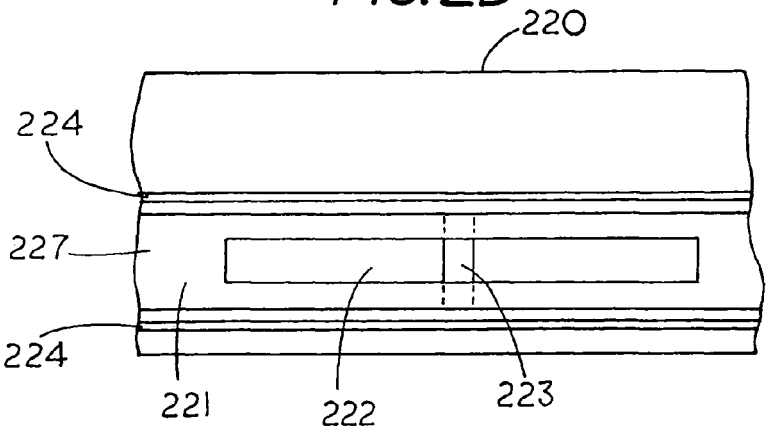
FIG. 2D shows a rescue ring with an independent rope reel having a detachable hook pocket located therein.

FIG. 2D shows a rescue ring 220 with an independent rope reel 221 rotatable connected to ring 220 by a bearing 224. In this example the reel 221 rotates independent of ring 220. An elongated hook pocket 222 or hollow in the reel forms a cavity for a hook and a post 223 enables one to hold a hook in elongated pocket 222 as the rescue ring 220 is thrown to a person in distress.

The invention shown in FIG. 2A comprises a throwable rotatable rescue device 200 with a detachable line 207 comprising an annular member with the annular member having an annular recess for storing and unwinding a cord therefrom as the rescue device is thrown with the attachment member securable in a pocket 203 within the ring in a position radially offset from a cord reel surface 225 to permit winding or unwinding of the cord 207 without interference of the attachment member as the rescue ring is thrown. Similarly, the example of FIG. 2 comprise a throwable rotatable rescue device 11 with a detachable line 13 with the annular member having an annular recess 13*a* for storing and unwinding a cord 13 therefrom as the rescue device is thrown with the attachment member securable in a pocket 15*a* or access port within the ring in a position radially offset from a cord reel surface to permit winding or unwinding of the cord 13 without interference of the attachment member as the rescue ring is thrown.

Figure 6:
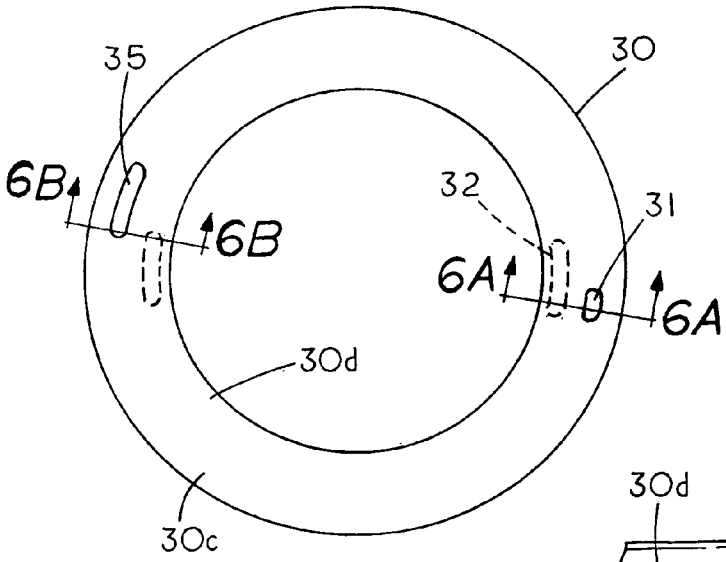
FIG. 6 is a top view of a rescue ring having a friction pad and a thumb pocket.
Figure 6A:
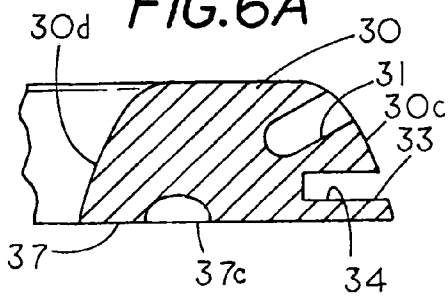
FIG. 6A is a cross-sectional view taken along lines 6A-6A if FIG. 6 showing a thumb slot.
Figure 8:
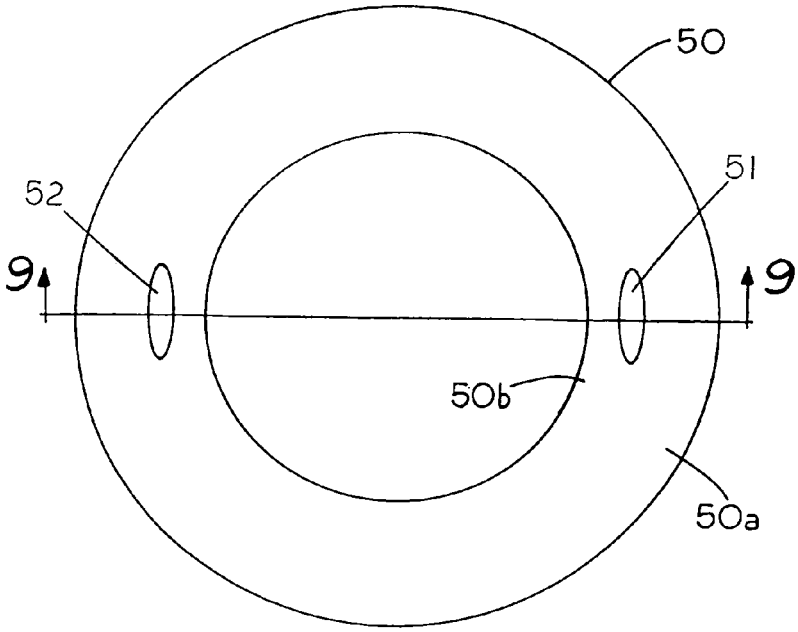
FIG. 8 is a top view of a set of finger slots located on an inner portion of a rescue ring.
Figure 10:
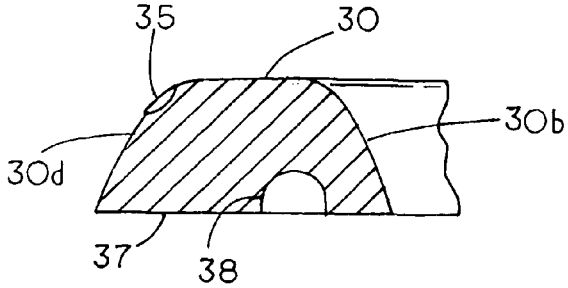
FIG. 10 is a cross sectional view taken along lines 6B-6B of FIG. 6.

FIG. 6 is a top view of an alternate embodiment of rescue ring 30 revealing two sets of gripping regions having different gripping aids for enhancing a users grasp on the rescue ring as the ring is tossed. Generally, the firmer a person can grip the rescue ring the greater distance the rescue ring can be thrown. Rescue ring 30, which is similar to rescue ring 11, includes a first elongated friction pad 35 located on the upper outer peripheral surface 30*c* and diametrically opposite side of annular ring 30 and in the upper outer peripheral surface 30*c* is a thumb pocket 31 for grasping the rescue ring. FIG. 6A which is taken along lines 6A-6A shows a finger or thumb pocket 37*a* located in underside surface 37. FIG. 10, which is taken along lines 6B-6B of FIG. 6 shows rescue ring 30 underside surface 37 with a pocket 38 located in alignment with friction pad 35 so the users thumb can be located in either the friction pad 35 or the pocket 38 while the users fingers are located in the other. In this example the friction pad 35 comprises an abrasive region which may include a sandpaper like structure or the like which is secured to or part of the rescue ring 30. Friction pad 35 has a circumferential length sufficiently long so that all the fingers of one hand can be placed on the friction pad as the friction pad is tossed. Similarly, pocket 38 is sufficiently long so that all the fingers of one hand can be placed in the pocket as the ring is tossed. FIG. 8 provides the thrower the option of using either set of gripping regions when throwing the rescue ring. That is, one may grip the ring 30 using friction pad 35 and finger pocket 38 or the user may grip the opposite side of rescue ring 30 by using thumb pocket 31 and finger pocket 37*a*.

Thus the thrower can select the set of gripping region which he or she believes will allow him to more accurately toss the rescue ring.

Figure 7:
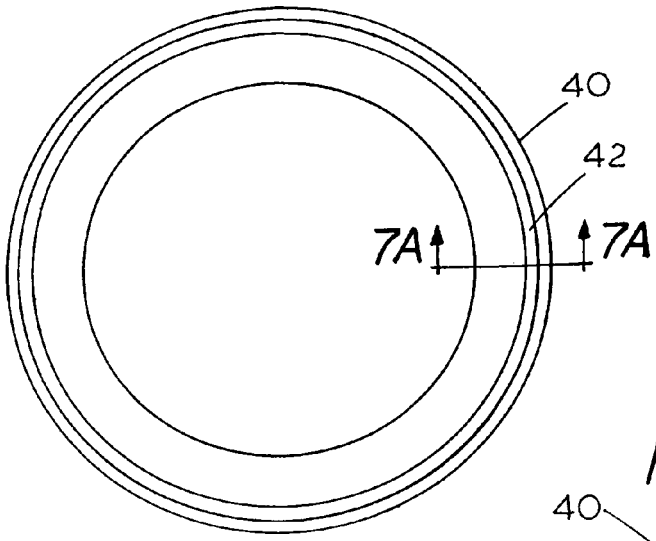
FIG. 7 is a top view of a rescue ring having a friction pad in the form of a ring extending around the rescue ring.

FIG. 7 shows an alternate embodiment of the invention showing a rescue ring 40 which is similar to rescue ring 30 wherein instead of a local friction pad, which extends partially around the rescue ring 40 there is provided a friction ring 42 that extends around the peripheral portion of ring 40 thus providing 360 degrees of enhancing gripping. Friction ring 42 may comprise an abrasive secured to a backing or the abrasive may be secured directly to the rescue ring 40. Rescue ring 40 similarly includes a 360 degree finger pocket 46 which is located in the under surface 41 of rescue ring 40.

Figure 7A:
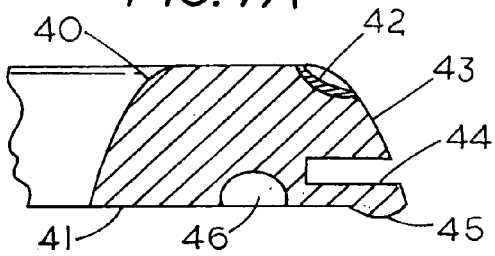
FIG. 7A is a cross sectional view taken along lines 7A-7A of FIG. 7 showing the friction ring and a lip on the rescue ring.

FIG. 7A is a cross sectional view taken along lines 7A-7A of FIG. 7 showing the friction ring 42 located in a recess on upper outer peripheral surface 43 and an annular air deflecting lip 45 on the lower annular surface 42. The finger pocket 46 is located in the annular under surface 41 and allows the user to place his or her fingers in finger pocket 46 while the thumb can be used to engage the friction ring 42 thus enhancing the users ability to throw the rescue ring regardless of where the rescue ring is grasped.

FIG. 8 is a top view of a rescue ring 50, which is similar to rescue ring 20. In this example, a set of finger pockets 51 and 52 are located on an inner upper portion 50*b* of a rescue ring 50 to enhance a persons ability enable person to grasp and accurately throw the rescue ring to a person in distress.

Figure 9:
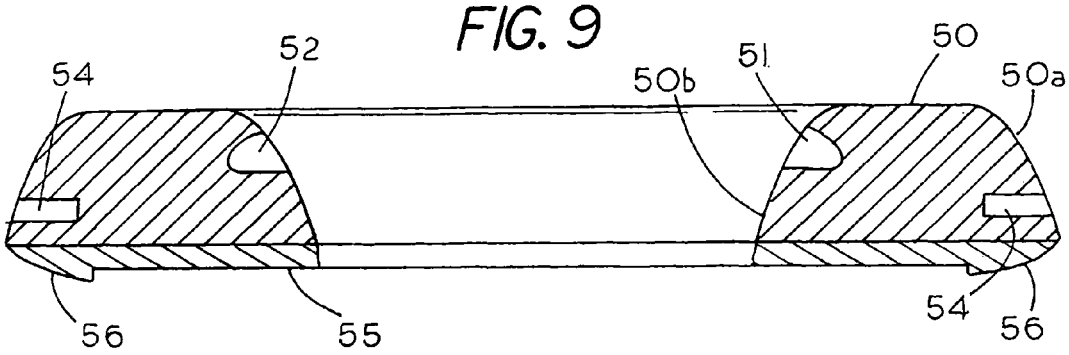
FIG. 9 is a cross sectional view taken along lines 9-9 of FIG. 8.

FIG. 9 is a cross sectional view taken along lines 9-9 of FIG. 8 revealing the finger pocket 51 and 52 located on the inner upper peripheral region of annular ring 50*b* while the upper outer peripheral ring 50 is free of finger or thumb holes. In this example an annular resilient cushion or pad 56 is secured to the underside of the rescue ring 50 to lessen the chance for injury to a person should the rescue ring accidentally land on the person being rescued. Typically, pad 56 comprises closed cell foam since it provides a cushion and it does not absorb water should the rescue ring be thrown to a person in the water. Other types of cushion may be used without departing from the spirit and scope of the invention, for example, an inflatable member may be secured to the ring to cushion an impact in the event the rescue ring lands on the person being rescued.

Figure 11:
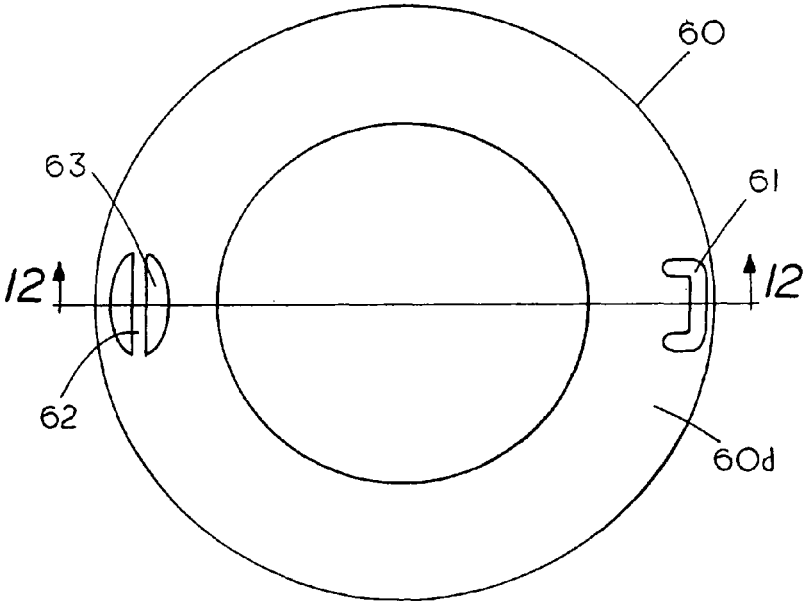
FIG. 11 is a top view of a rescue ring with different types of handles.
Figure 11A:
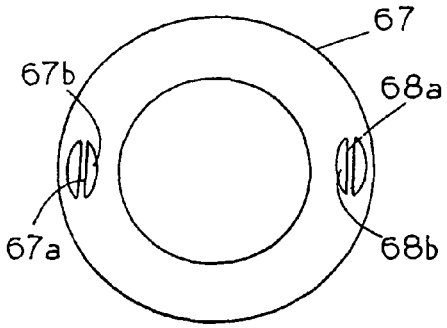
FIG. 11A is a top view of a rescue ring with internal handles.
Figure 11B:
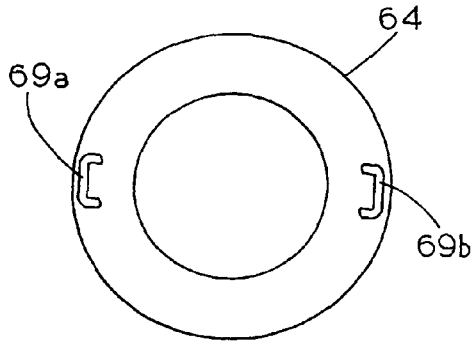
FIG. 11B is a top view of a rescue ring with external handles.
Figure 12:
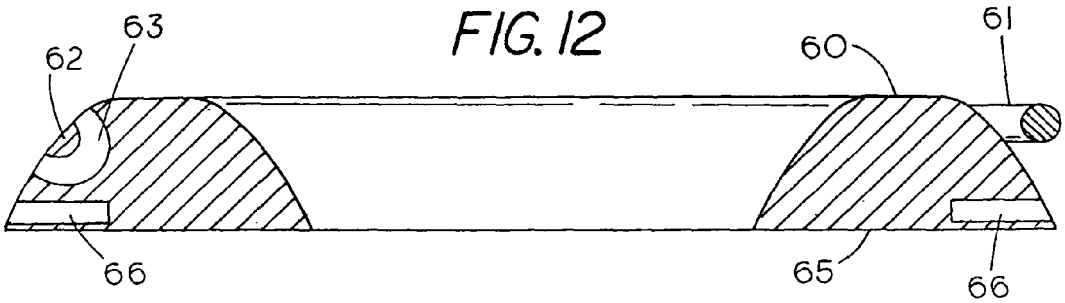
FIG. 12 is a cross sectional view taken along lines 12-12 of FIG. 11.

FIG. 11 is a top view of a rescue ring 60, which is similar to rescue ring 20 but includes different sets of handles on opposite sides of the rescue ring. FIG. 12 is a cross sectional view of the rescue ring 60 taken along lines 12-12 of FIG. 11. In this example, the rescue ring 60 includes an internal surface handle 62 with a pocket 63 for a user to place his or her fingers in. On the opposite side there is an external handle 61 that extends outward from outer upper peripheral region 60*d*. Rescue ring 60 includes a reel recess 66 as well as a plane annular under surface 65. A user may select either of the handles 61 or 62 for throwing the rescue ring. Ring 60 includes a smooth annular underside 65 and an open ended pocket (not shown) for holding and securing a hook in a location where the hook does not interfere with the throwing of the rescue ring but allows the hook to be quickly detached from the rescue ring. While FIG. 11 shows an internal and external handles located on diametrically opposite sides of the rescue ring one may want to minimize dynamic unbalance with use of different handles on the same rescue ring. One way of ionizing dynamic unbalance is to place a set of external handles diametrically opposite from one another and another set of internal handles diametrically opposite from one another but at a 90 degree angle to the first set of handles. The thrower then has the option of selecting either of the four handles.

FIGS. 13-19 show various example of how a rescue ring may be configured depending on the particular use for the rescue ring. That is, some rescue rings may be used both for docking and water rescue while others may be used for water rescue and still others may be for land rescues.

Figure 13:
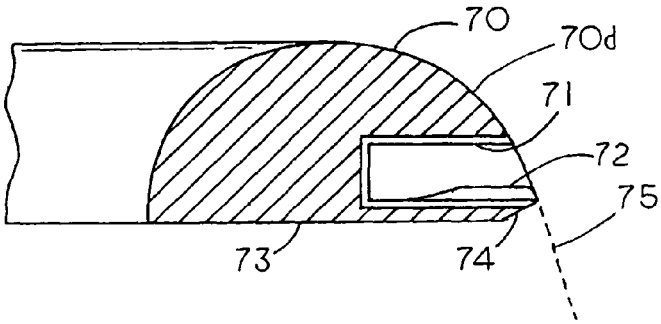
FIG. 13 is a cross sectional view of a rescue ring showing the position of the lip with respect to the body of the rescue ring.

FIG. 13 is a cross sectional view of a rescue ring 70 showing the position of a reel lip with respect to the body of the rescue ring. In this example the angle of the outer upper peripheral region continues past the reel 71 as indicated by dashed line 75. Rescue ring 70 includes an internal lip 72 which reduces the open area of the cord reel 71 to lessen drag caused by reel 71. A lower annular lip 74 directs the air to the under side 73 of the rescue with the under side 73 of rescue ring comprising an annular plane surface to further reduce aerodynamic drag.

Figure 14:
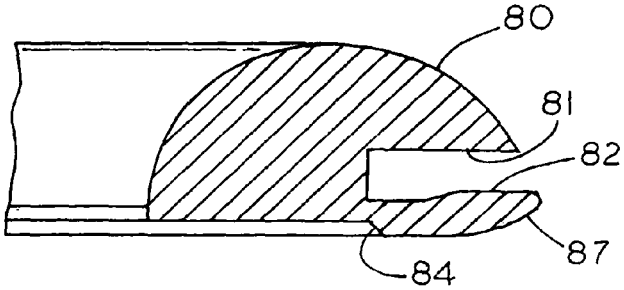
FIG. 14 is a cross sectional view of a rescue ring having an annular cup or lip for hand engaging the rescue ring.

FIG. 14 is a cross sectional view of a rescue ring 80 having an annular lip or cup 84 for hand engaging the under side of the rescue ring. In this example the reel pocket 81 includes an internal lip 82 for lessening the drag and the underside of the reel contains a contoured surface 87 that diverts air beneath the rescue ring as the rescue ring is thrown through the air.

Figure 15:
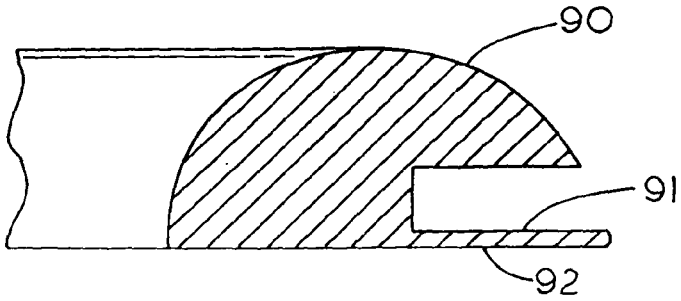
FIG. 15 is a cross sectional view of a rescue ring with a smooth under side.

FIG. 15 is a cross sectional view of a rescue ring 90 with a smooth under side 92 and an annular reel recess 91. This unit may be used for those applications where the flying distance of the rescue ring is not as critical.

Figure 16:
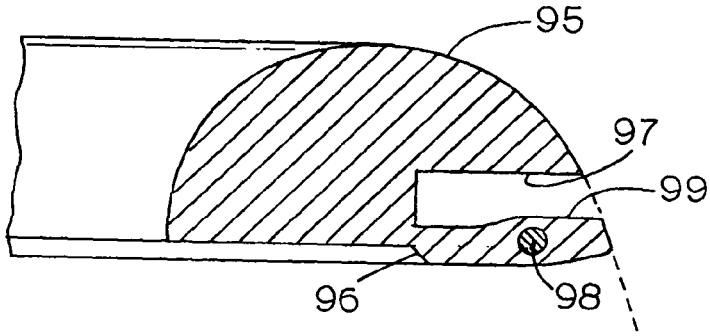
FIG. 16 is a cross sectional view of a rescue ring with a weight embedded in the peripheral region of the rescue ring.

FIG. 16 is a cross sectional view of a rescue ring 95 having a reel recess formed by annular surface 97 and annular surface 99. In this example an annular weight or mass 98 is embedded in the peripheral region of the rescue ring 95 to enhance the ability to throw the rescue ring over long distances. The mass 98 may be molded into the rescue ring 95 and surrounded by the material of the rescue ring to ensure that if the rescue ring should accidentally hit a person being rescue it would not cause any harm to the person.

Figure 17:
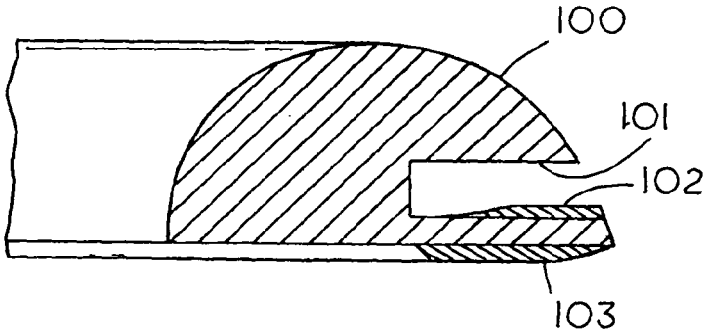
FIG. 17 is a cross sectional view of a rescue ring with annular outer edges having a greater density than the rescue ring.

FIG. 17 is a cross sectional view of a rescue ring 100 where a heavier mass material 102 and 103 have been molded directly into the outer peripheral region of the rescue ring 100 to enhance the range of the rescue ring. In this example the mass material 102 is formed as a lower surface of the reel with the upper reel surface 101 being free of weighted material.

Figure 18:
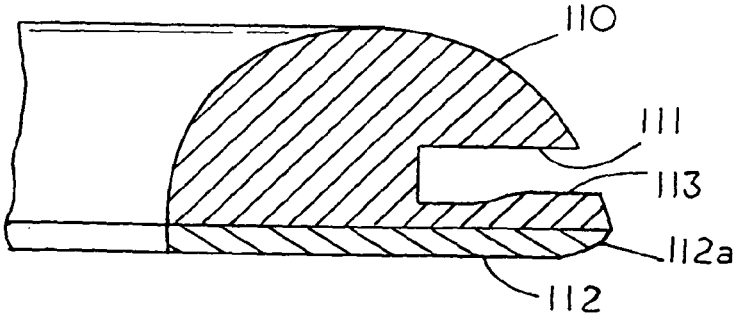
FIG. 18 is a cross sectional view of a rescue ring with a resilient pad located on the underside of the rescue ring.

FIG. 18 is a cross sectional view of a rescue ring 110 with an annular resilient pad 112 located on the underside of the rescue ring 110. Resilient pad 112 comprises a compressible material that cushions the impact if the rescue ring accidentally lands on a person being rescued. Rescue ring 110 includes an upper annular reel surface and a lower annular reel lip 113 for reducing the open frontal area of the rescue ring. Resilient pad 112 includes a tapered lip 112*a* for directing air flow under the rescue ring.

Figure 19:
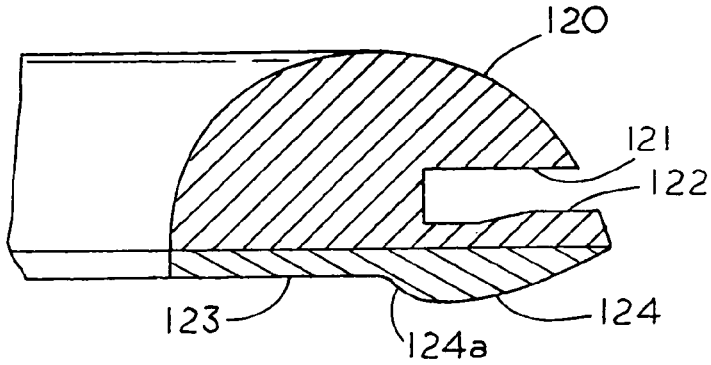
FIG. 19 is a cross sectional view of a rescue ring with a lip.

FIG. 19 is a cross sectional view of a rescue ring 12 similar to the rescue ring 110 of FIG. 18 except the annular resilient pad 123 on the bottom of the rescue ring includes a tapered lip 124 to direct the air to the underside of the rescue ring with the lip protruding therefrom to enable a user to better grasp the underside of the rescue ring. The reel recess is formed by annular surface 121 and the annular surface 122 which comprises an annular lip that reduce the frontal open area of the rescue ring 120. While a variety of gripping means are shown the gripping means may be selected based on whether the rescue ring is to be thrown in a Frisbee type throw or a swinging slingshot like throw since the gripping of the rescue ring is different for each type of throw. For example, the smaller rescue rings i.e. up to 24 inch diameter may use a Frisbee throw where the top and bottom of the rescue ring is grasped between the thumb and the fingers. The larger rescue rings i.e. over 24 inch diameter may use a swinging slingshot like throw where the inside and underside of the rescue ring is grasped. In some cases one may want to have multiple types of grasping regions on the rescue ring so that the thrower can select the gripping method, which he or she is more comfortable with.

It should be pointed out that the various embodiments of the rescue rings shown FIG. 6 to FIG. 19 may all be used with the detachable hook 12 which is shown in FIGS. 1-5.

Figure 20:
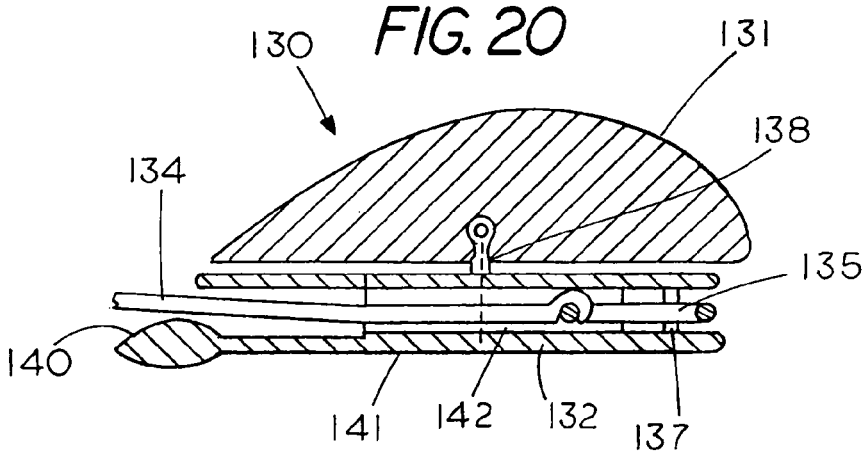
FIG. 20 is a cross sectional view of a rescue ring having a rotatable reel.
Figure 21:
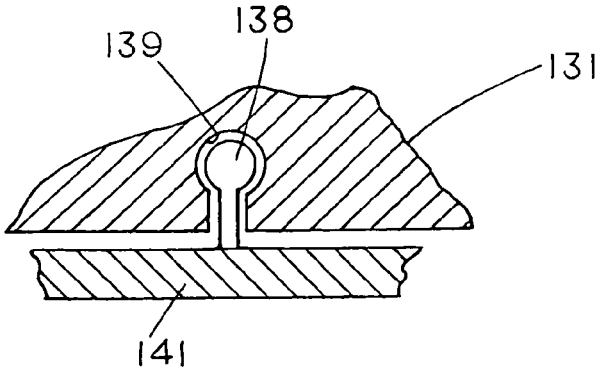
FIG. 21 is an enlarged view of the rotational link between the annular ring and the rotatable reel.

FIG. 20 and FIG. 21 show an alternate embodiment of a rescue ring 130 that includes a reel 132 that rotates independently of the annular ring 131. An annular member 138 sliding fits within a cylindrical cavity 139 in annular ring 131 with a cylindrical neck 138*a* connecting ring 131 to reel 132. In this example reel 132 rotates independently of annular ring 131.

Rescue ring 130 also includes the feature of a detachable hook 135, however, in this embodiment the detachable hook 135, which is identical to the hook 12, mounts to a post 137 located in a pocket 142 in reel 132. A cord 134 connects to hook 135 so that a person can be pulled to safety by grasping the rescue ring 131. In addition the rescue system 130 may also be used for other purposes including docking of boats or the like since one can unhook the cord 134 and hook 135 from the reel 141 and attach the 135 to a boat to enable one to pull the boat to dock.

FIG. 21 is an enlarged view of the rotational relationship between annular member 131 and reel 141. A cylindrical extension 138 fits within a cylindrical race 139 in annular ring 131 to enable the reel 141 to rotate with respect to the annular reel and at the same time allow a hook to be detachably mounted to the reel 141. Other variations of rotatable reels that rotate independently of the rescue ring may be used without departing from the spirit and scope of the inventions described herein.

Figure 22:
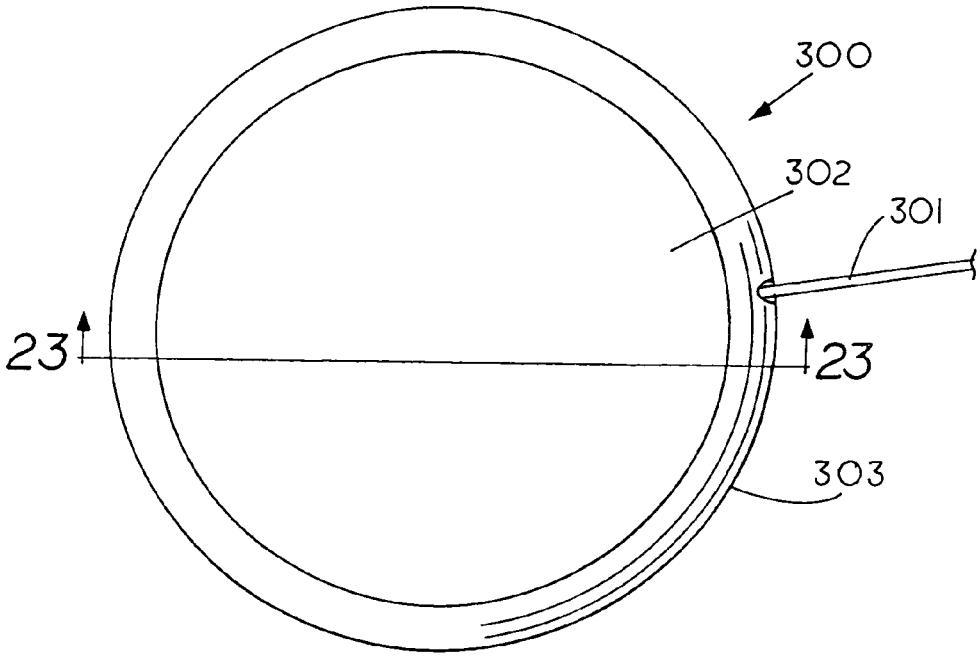
FIG. 22 is a top view of a Frisbee like open bottom closed top disk.

FIG. 22 is a top view or a Frisbee like open bottom closed top disk 300 for aerial delivery of a cord with a detachable hook to a person. Disk 300 includes a closed slightly domed top 302 and an angle side 303 so as to mimic a Frisbee shape. A cord 30 extends radially outward from a cord reel located in the rim of disk 300.

Figure 23:
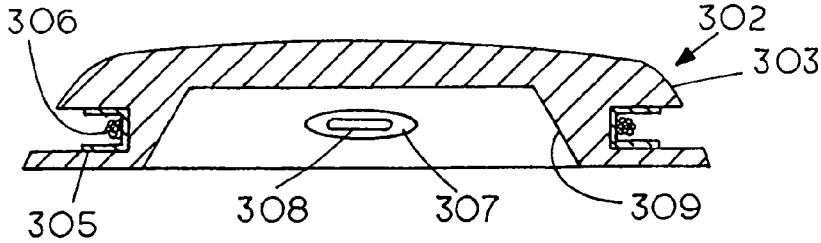
FIG. 23 is a sectional view taken along lines 23-23 of FIG. 22

FIG. 23 is a sectional view taken along lines 23-23 of FIG. 22 to reveal the interior of disk 300 with a cord reel 305 having a cord 306 wound thereabout. Located in the rim of disk 300 is a hook pocket 307 with a hook 308 held therein by a post or the like. In this example the method and means for securing the hook is identical to the method and means shown in annular rescue ring ??? The open end pocket allow a user to reach through an opening in the eal and realas hook 308. ring.

Figure 24:
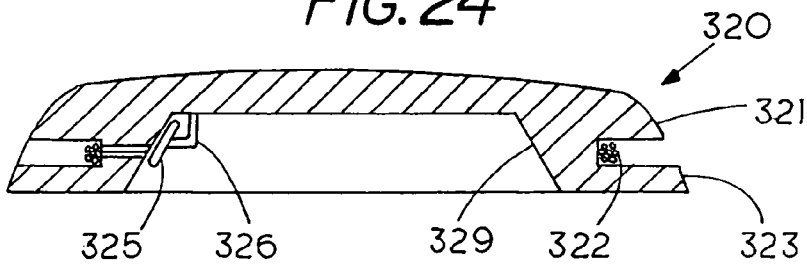
FIG. 24 is a cross section of an alternate embodiment of a disk.

FIG. 24 is a cross section of an alternate embodiment of a similar disk 320 that includes a side 321 and lip 323 with a rope cavity having a rope 372 therein. The underside of disk 30 includes a surface for grasping the disk 320 as the disk with the rescue cord is thrown to a person in a remote position. In this example the hook 325 which has one end attached to cord 372 is located on the inside of the disk 320 with a body hook 326 securing the hook 325 to the inner rim of the disk 320. By relapsing body hook 326 the hook 325 can be slide through an open pocket ?? to the outside of disk 320 wherepooin the hook 325 may be attached to an object for pulling the object toward the thrower.

I claim:

1. A throwable rotatable rescue device with a detachable line comprising:

an annular member having an upper outer peripheral surface having an airfoil shape and an inner upper peripheral surface having an airfoil shape, with the upper outer peripheral surface forming a leading edge of the annular member and the inner upper peripheral surface forming a trailing edge of the annular member with said annular member having an annular recess for storing and unwinding a cord therefrom as the rescue device is thrown;

a lower surface connecting an edge of the upper outer peripheral surface to an edge of the inner upper peripheral surface;

a post located on said annular member; and an attachment member securable to a cord and to the post on the annular ring for maintaining engagement with the annular ring when the rescue device is thrown but detachable after the rescue device has been thrown.

2. The throwable rotatable rescue device of claim 1 wherein the attachment member comprises a detachable hook and the annular ring includes a pocket comprising a hollow therein for retaining the attachment member at least partially radially inward of an annular cord reel surface so as to prevent the attachment member from interfering with the winding or winding of the cord therefrom.

3. The throwable rotatable rescue device of claim 1 wherein the annular member contains an open ended pocket extending through the annular member with the attachment member hand accessible from within the pocket in the annular member to enable release of the attachment member from the rescue device.

4. The throwable rotatable rescue device of claim 1 wherein the upper outer peripheral surface includes a finger pocket and the lower surface includes a finger pocket.

5. The throwable rotatable rescue device of claim 1 wherein the upper outer peripheral surface includes a friction ring and the lower surface includes a finger pocket.

6. The throwable rotatable rescue device of claim 1 wherein the inner upper peripheral surface includes a thumb pocket and the lower surface includes a finger pocket.

7. The throwable rotatable rescue device of claim 1 wherein the upper outer peripheral surface includes a finger pocket and the lower surface includes a resilient cushion.

8. The throwable rotatable rescue device of claim 1 wherein the upper outer peripheral surface includes a handle.

9. The throwable rotatable rescue device of claim 1 wherein the annular recess includes an annular lip.

10. The throwable rotatable rescue device of claim 1 wherein the lower surface includes a 360-degree cupping ridge.

11. A throwable rotatable rescue device with a detachable line comprising:

an annular member having an upper outer peripheral surface having an airfoil shape and an inner upper peripheral surface having an airfoil shape, with the upper outer peripheral surface forming a leading edge of the annular member and the inner upper peripheral surface forming a trailing edge of the annular member with said annular member having an annular recess for storing and unwinding a cord therefrom as the rescue device is thrown;

said upper outer peripheral surface including a peripheral weight having a greater density than the density of the rescue ring a lower surface connecting an edge of the upper outer peripheral surface to an edge of the inner upper peripheral surface; and an attachment member securable to a cord and to the annular ring for maintaining engagement with the annular ring when the rescue device is thrown but detachable after the rescue device has been thrown.

12. The throwable rotatable rescue device of claim 1 wherein the mass of the outer portion of the rescue ring is greater than the mass of an inner portion of the rescue ring.

13. The throwable rotatable rescue device of claim 1 wherein the lower surface includes a cushion formed from a layer of closed cell foam.

14. The throwable rotatable rescue device of claim 1 wherein the lower surface includes a layer of closed cell foam with a grasping edge thereon.

15. A throwable rotatable rescue device with a detachable line comprising:

an annular member having an upper outer peripheral surface having an airfoil shape and an inner upper peripheral surface having an airfoil shape, with the upper outer peripheral surface forming a leading edge of the annular member and the inner upper peripheral surface forming a trailing edge of the annular member with said annular member having an annular recess for storing and unwinding a cord therefrom as the rescue device is thrown said annular member includes a rotatable reel;

a lower surface connecting an edge of the upper outer peripheral surface to an edge of the inner upper peripheral surface; and an attachment member securable to a cord and to the annular ring for maintaining engagement with the annular ring when the rescue device is thrown but detachable after the rescue device has been thrown.

16. The throwable rotatable rescue device of claim 15 wherein the rotatable reel includes a pocket therein for obtaining access to the attachment member from central interior of the rotatable reel.

17. A throwable rotatable rescue device with a detachable line comprising: an annular member with said annular member having an annular recess for storing and unwinding a cord therefrom as the rescue device is thrown said annular member having a pocket located within the annular member; a post; and an attachment member securable in the pocket within the ring in a position radially offset from a cord reel surface to permit winding or unwinding of the cord without interference of the attachment member as the rescue ring is thrown.

* * * * *